US010826182B2

(12) United States Patent
Kyllonen

(10) Patent No.: US 10,826,182 B2
(45) Date of Patent: Nov. 3, 2020

(54) THROUGH-HOLE INVERTED SHEET METAL ANTENNA

(71) Applicant: Carrier Corporation, Palm Beach Gardens, FL (US)

(72) Inventor: Kimmo Antero Kyllonen, Shakopee, MN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/340,921

(22) PCT Filed: Oct. 10, 2017

(86) PCT No.: PCT/US2017/055889

§ 371 (c)(1),
(2) Date: Apr. 10, 2019

(87) PCT Pub. No.: WO2018/071388

PCT Pub. Date: Apr. 19, 2018

(65) Prior Publication Data

US 2019/0273323 A1 Sep. 5, 2019

Related U.S. Application Data

(60) Provisional application No. 62/407,079, filed on Oct. 12, 2016.

(51) Int. Cl.
*H01Q 9/04* (2006.01)
*H01Q 5/371* (2015.01)

(52) U.S. Cl.
CPC ..... *H01Q 9/0421* (2013.01); *H01Q 5/371* (2015.01); *H01Q 9/0407* (2013.01); *H01Q 9/0414* (2013.01); *H01Q 9/0471* (2013.01)

(58) Field of Classification Search
CPC ..... H01Q 9/0421
See application file for complete search history.

(56) References Cited

U.S. PATENT DOCUMENTS 6,114,996 A * 9/2000 Nghiem ..... H01Q 1/24 343/700 MS
6,297,776 B1 * 10/2001 Pankinaho ..... H01Q 1/243 343/700 MS (Continued)

FOREIGN PATENT DOCUMENTS

| | | |
|---|---|---|
| CN | 1753248 A | 3/2006 |
| CN | 203631738 U | 6/2014 |
| EP | 2750248 A1 | 7/2014 |

OTHER PUBLICATIONS

International Search Report and Written Opinion for application PCT/US2017/055889, dated Jan. 19, 2018, 5 pages.

*Primary Examiner* — Ab Salam Alkassim, Jr.
(74) *Attorney, Agent, or Firm* — Cantor Colburn LLP

(57) ABSTRACT

A single piece of sheet metal antenna as well as a method and system for providing the antenna are provided. The single piece of sheet metal antenna includes a reflector/shield portion formed of a lower surface that extends in a horizontal direction and includes a through-hole, an antenna portion formed of an upper surface that extends in the horizontal direction and a vertically extending side that is joined between the upper surface and the lower surface, and a feed point formed of a through-hole flap attached and extending from the upper surface down and through the through-hole of the lower surface.

18 Claims, 7 Drawing Sheets

(56) References Cited

U.S. PATENT DOCUMENTS 6,346,914 B1 * 2/2002 Annamaa ..... H01Q 5/357 343/700 MS
6,448,932 B1 9/2002 Stoiljkovic et al.
6,476,769 B1 * 11/2002 Lehtola ..... H01Q 1/243 343/700 MS
6,593,888 B2 7/2003 Fu
6,741,214 B1 5/2004 Kadambi et al.
6,806,831 B2 * 10/2004 Johansson ..... H01Q 9/0414 343/700 MS
6,836,252 B2 12/2004 Tai et al.
6,850,196 B2 * 2/2005 Wong ..... H01Q 1/243 343/702
6,850,200 B2 * 2/2005 Tracy ..... H01Q 9/0421 343/700 MS
6,864,854 B2 3/2005 Dai et al.
7,161,541 B2 1/2007 Chen
7,183,980 B2 2/2007 Chang et al.
7,482,978 B2 1/2009 Yang et al.
7,589,682 B1 * 9/2009 Wu ..... H01Q 1/2258 343/700 MS
7,782,270 B2 8/2010 Chung et al.
8,081,127 B2 * 12/2011 Chen ..... H01Q 1/243 343/702
8,274,436 B2 9/2012 Huang
8,390,523 B2 3/2013 Wang et al.
8,654,014 B2 2/2014 Ling et al.
8,742,992 B2 6/2014 Kai et al.
8,994,596 B2 3/2015 Du et al.
9,293,826 B2 3/2016 Yonei et al.
10,418,709 B1 * 9/2019 Furlan ..... H01Q 9/42
2002/0171587 A1 * 11/2002 Fu ..... H01Q 9/0442 343/700 MS
2003/0016177 A1 * 1/2003 Deguchi ..... H01Q 9/0421 343/702
2003/0038750 A1 2/2003 Chen
2006/0012524 A1 * 1/2006 Mierke ..... H01Q 9/0421 343/700 MS
2006/0164304 A1 * 7/2006 Huang ..... H01Q 9/0414 343/700 MS
2007/0008221 A1 * 1/2007 Tseng ..... H01Q 1/38 343/700 MS
2008/0143608 A1 6/2008 Watanabe et al.
2010/0265157 A1 10/2010 Yang et al.
2011/0043408 A1 * 2/2011 Shi ..... H01Q 1/48 343/700 MS
2011/0128189 A1 * 6/2011 Shimasaki ..... H01Q 1/2266 343/700 MS
2014/0197996 A1 * 7/2014 Yonei ..... H01Q 5/364 343/700 MS
2014/0210674 A1 * 7/2014 Yonei ..... H01Q 9/0407 343/700 MS
2016/0149303 A1 * 5/2016 Mcgough ..... H01Q 9/0421 343/767
2016/0172750 A1 * 6/2016 Ng ..... H01Q 1/521 343/841

* cited by examiner

THROUGH-HOLE INVERTED SHEET METAL ANTENNA

BACKGROUND

The subject matter disclosed herein generally relates to antennas and, more particularly, to forming metal antennas.

Many antennas currently include at least a sheet metal piece, one or more coaxial cables, and one or more RF-connector assemblies. The inclusion of all these comments increases the overall cost of the device. Also including these components can require additional tuning for each component when created and then again when assembled together. Further, having additional contact points provide additional points at which signal noise can be created and further provide points where disconnection can occur. Thus, by including multiple components, the antenna device can become complex and costly. Further, such antenna device arrangements require a large amount of device space to house all the components. Further, size reduction practice is limited as the particular parts cannot be reduced in size easily.

Thus, there is a desire to provide improvements in metal antenna design.

BRIEF DESCRIPTION

According to one embodiment a single piece of sheet metal antenna is provided. The single piece of sheet metal antenna includes a reflector/shield portion formed of a lower surface that extends in a horizontal direction and includes a through-hole, an antenna portion formed of an upper surface that extends in the horizontal direction and a vertically extending side that is joined between the upper surface and the lower surface, and a feed point formed of a through-hole flap attached and extending from the upper surface down and through the through-hole of the lower surface.

In addition to one or more of the features described above, or as an alternative, further embodiments may include, wherein the lower surface and the through-hole flap are configured to attach to a printed circuit board (PCB).

In addition to one or more of the features described above, or as an alternative, further embodiments may include wherein the reflector/shield portion further includes a vertically extending edge at an end opposite the end where the vertically extending side is joined, wherein the vertically extending edge is formed by bending the reflector/shield portion.

In addition to one or more of the features described above, or as an alternative, further embodiments may include, wherein the reflector/shield portion further includes a first peg extending from an edge of the through-hole downward toward the PCB.

In addition to one or more of the features described above, or as an alternative, further embodiments may include wherein the reflector/shield portion further includes a second peg and a third peg extending from the vertically extending edge downward toward the PCB, and a fourth peg attached to an outer edge of the reflector/shield portion and extending downward toward the PCB.

In addition to one or more of the features described above, or as an alternative, further embodiments may include wherein the feed point further includes a horizontally extending foot portion formed at an end of the feed point that extends downward, wherein the foot portion is formed by bending the end of the feed point.

In addition to one or more of the features described above, or as an alternative, further embodiments may include wherein corners are cut into rounded forms.

In addition to one or more of the features described above, or as an alternative, further embodiments may include wherein the sheet of metal is made from one or more selected from a group consisting of copper, copper alloy, stainless steel, phosphorous bronze, beryllium copper, and aluminum.

In addition to one or more of the features described above, or as an alternative, further embodiments may include wherein the sheet of metal is 0.3 millimeters (mm) thick.

In addition to one or more of the features described above, or as an alternative, further embodiments may include wherein the lower surface of the reflector/shield portion is 35 millimeters (mm) long and 8 mm wide and the through-hole of the reflector/shield portion is 23 mm long and 4 mm wide, wherein the upper surface of the antenna portion is 28.1 mm long and 8 mm wide and the vertically extending side of the antenna portion is 5 mm tall and 8 mm wide, and wherein the feed point is 8 mm tall and 1 mm wide.

In addition to one or more of the features described above, or as an alternative, further embodiments may include wherein the feed point is 5 millimeters (mm) away from the vertically extending side of the antenna portion, and wherein the through-hole of the reflector/shield portion is 3 mm from the vertically extending side of the antenna portion.

In addition to one or more of the features described above, or as an alternative, further embodiments may include wherein the vertically extending edge of the reflector/shield portion is 2.5 millimeters (mm) tall and 8 mm wide, and In addition to one or more of the features described above, or as an alternative, further embodiments may include wherein the first peg is 3 millimeters (mm) tall and 4 mm wide.

According to one embodiment a system for wireless communication is provided. The system includes a single sheet of metal antenna including a reflector/shield portion formed of a lower surface that extends in a horizontal direction and includes a through-hole, an antenna portion formed of an upper surface that extends in the horizontal direction and a vertically extending side that is joined between the upper surface and the lower surface, and a feed point formed of a through-hole flap attached and extending from the upper surface down and through the through-hole of the lower surface.

In addition to one or more of the features described above, or as an alternative, further embodiments may include a printed circuit board upon which the lower surface and the through-hole flap of the single sheet of metal antenna are attached.

In addition to one or more of the features described above, or as an alternative, further embodiments may include a vertically extending edge at an end opposite the end where the vertically extending side is joined, wherein the vertically extending edge is formed by bending the reflector/shield portion, a first peg extending from an edge of the through-hole downward toward the PCB, a second peg and a third peg extending from the vertically extending edge downward toward the PCB, and a fourth peg attached to an outer edge of the reflector/shield portion and extending downward toward the PCB.

In addition to one or more of the features described above, or as an alternative, further embodiments may include a horizontally extending foot portion formed at an end of the feed point that extends downward, wherein the foot portion is formed by bending the end of the feed point.

In addition to one or more of the features described above, or as an alternative, further embodiments may include wherein corners are cut into rounded forms.

In addition to one or more of the features described above, or as an alternative, further embodiments may include wherein the sheet of metal is made from one or more selected from a group consisting of copper, copper alloy, stainless steel, phosphorous bronze, beryllium copper, and aluminum.

In addition to one or more of the features described above, or as an alternative, further embodiments may include wherein the sheet of metal is 0.3 millimeters (mm) thick, wherein the lower surface of the reflector/shield portion is 35 millimeters (mm) long and 8 mm wide and the through-hole of the reflector/shield portion is 23 mm long and 4 mm wide, wherein the upper surface of the antenna portion is 28.1 mm long and 8 mm wide and the vertically extending side of the antenna portion is 5 mm tall and 8 mm wide, wherein the feed point is 8 mm tall and 1 mm wide, wherein the feed point is 5 millimeters (mm) away from the vertically extending side of the antenna portion, wherein the through-hole of the reflector/shield portion is 3 mm from the vertically extending side of the antenna portion, wherein the vertically extending edge of the reflector/shield portion is 2.5 millimeters (mm) tall and 8 mm wide, and wherein the first peg is 3 millimeters (mm) tall and 4 mm wide.

According to one embodiment a method to create a single sheet of metal antenna is provided. The method includes receiving a sheet of metal, cutting a plurality of incisions in the sheet metal, discarding metal parts that are no longer attached to the sheet of metal, and bending the sheet of metal along a plurality of bend points to form an antenna such as that of claim 1.

In addition to one or more of the features described above, or as an alternative, further embodiments may include wherein cutting a plurality of incision in the sheet metal includes one or more of making the incisions using stamping and making the incisions using etching.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Embodiments described herein are directed to a single sheet of metal being cut and bend into an antenna. Specifically, one or more embodiments are directed toward a through-hole inverted sheet metal antenna formed out of single piece of sheet metal that does not use cables or connectors to connect with a printed circuit board (PCB).

Figure 1:
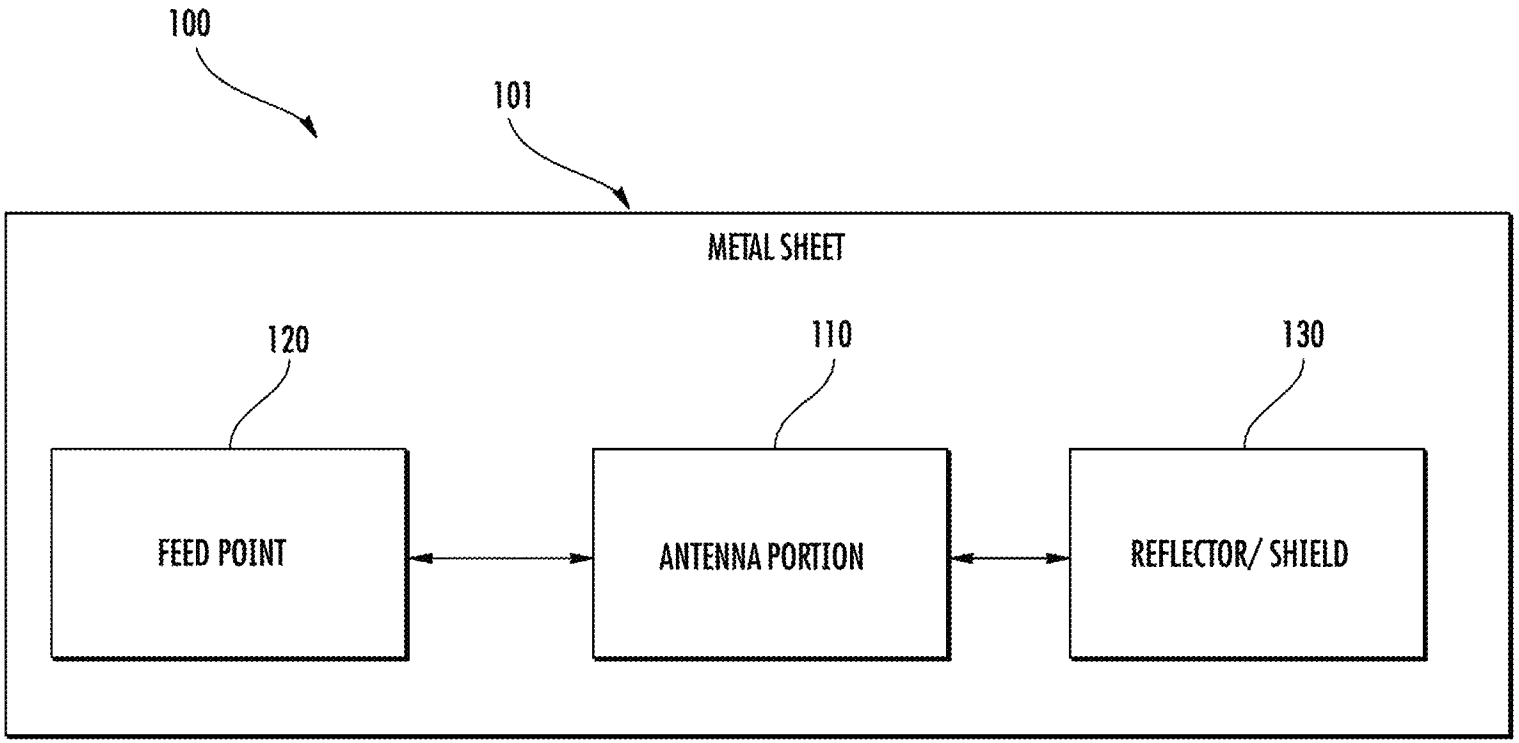
FIG. 1 is a block diagram of an antenna in accordance with one or more embodiments.

For example, turning now to FIG. 1, a block diagram of an antenna 100 is shown in accordance with one or more embodiments. The antenna 100 consists of a single piece of sheet metal 101. Formed into the metal sheet 101 are at least three components. Particularly, the antenna 100 includes an antenna portion 110, a feed point 120, and a reflector/shield 130.

Specifically, in accordance with one or more embodiments, the antenna portion 110 is integrally formed and connected to the feed point 120. The feed point 120 is configured to not only integrally connect at one end to the antenna portion 110 but is also configured to connect to a printed circuit board (PCB).

Further, the antenna is also connected to a reflector/shield portion 130. This reflector/shield portion 130 is formed such that is can shield the antenna portion 110 from undesired noise and signal interferences that are transmitting through the PCB. Additionally, the same reflector/shield portion 130 can also reflect signal back toward the antenna portion 110 so that the antenna portion 110 can better capture wireless signals.

Figure 2:
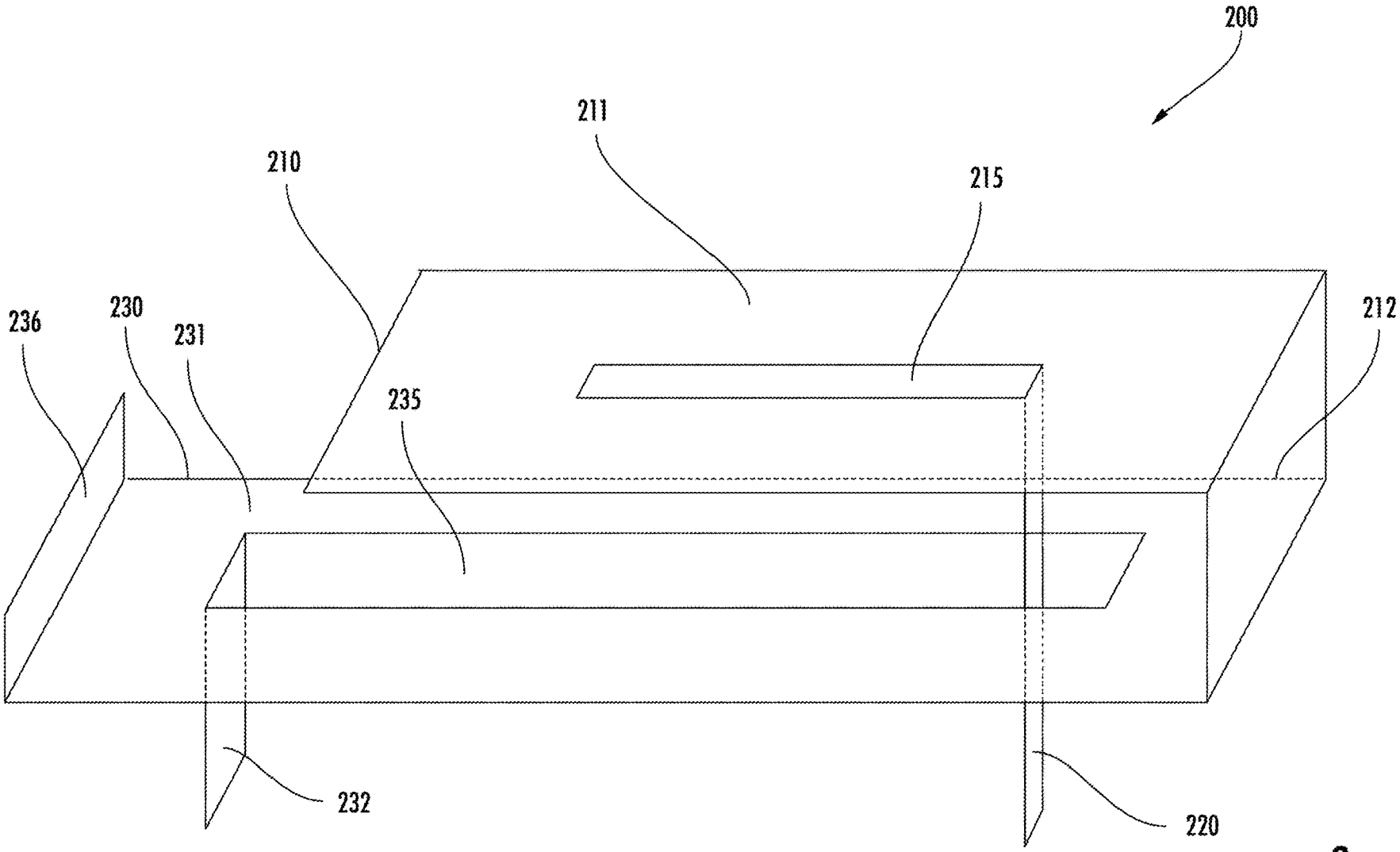
FIG. 2 is a perspective view of an antenna in accordance with one or more embodiments.

FIG. 2 is a perspective view of an antenna 200 in accordance with one or more embodiments. The antenna 200 include a reflector/shield portion 230 formed of a lower surface 231 that extends in a horizontal direction and includes a through-hole 235. The antenna 200 also includes an antenna portion 210 formed of an upper surface 211 that extends in the horizontal direction and a vertically extending side 212 that is joined between the upper surface 211 and the lower surface 231. The antenna portion 210 also includes a through-hole 215. The antenna 200 also includes a feed point 220 formed of a through-hole flap 220 attached and extending from the upper surface 211 down and through the through-hole 235 of the lower surface 231. According to one or more embodiments, the lower surface 231 and the through-hole flap 220 can attach to a printed circuit board (PCB).

According to one or more embodiments, the reflector/shield portion 230 can include a vertically extending edge 236 at an end opposite the end where the vertically extending side 212 is joined to the lower surface 231. The vertically extending edge 236 is formed by bending the lower surface 231 of the reflector/shield portion 230 to form the vertically extending edge 236 as shown in FIG. 2. According to one or more embodiments, the bend may occur in either direction and at various angles relative to a point of reference. For example, according to one or more embodiments, the bend may be provided with an angle value of 90 degrees, 45 degrees, 30 degrees, or other degree values.

Further, according to one or more embodiments, the reflector/shield portion 230 can further include a first peg 232 extending from an edge of the through-hole 235 downward toward the PCB. This first peg 232 can be used to connect the antenna 200 to a PCB. According to other embodiments, the first peg 232 can be placed extending down from any of the other edges of the through-hole 235.

According to one or more embodiments, the sheet of metal that forms the antenna 200 is about 0.3 millimeters (mm) thick. According to other embodiments, the thickness of the antenna 200 can vary in accordance with structural and/or signal propagation/transmittance requirements.

According to one or more embodiments, the lower surface 231 of the reflector/shield portion 230 is about 35 millimeters (mm) long and about 8 mm wide and the through-hole 235 of the reflector/shield portion 230 is about 23 mm long and about 4 mm wide. According to other embodiments, the dimensions of these elements can vary in accordance with structural and/or signal propagation/transmittance requirements.

According to one or more embodiments, the upper surface 211 of the antenna portion 210 is about 28.1 mm long and about 8 mm wide and the vertically extending side 212 of the antenna portion 210 is about 5 mm tall and about 8 mm wide. According to other embodiments, the dimensions of these elements can vary in accordance with structural and/or signal propagation/transmittance requirements.

According to one or more embodiments, the feed point 220 is about 8 mm tall and about 1 mm wide. Further, according to one or more embodiments, the feed point 220 is about 5 millimeters (mm) away from the vertically extending side 212 of the antenna portion 210. According to other embodiments, the dimensions of this element can vary in accordance with structural and/or signal propagation/transmittance requirements.

According to one or more embodiments, the through-hole 235 of the reflector/shield portion 230 is about 3 mm from the vertically extending side 212 of the antenna portion 210. Further, according to one or more embodiments, the vertically extending edge 236 of the reflector/shield portion 230 is about 2.5 millimeters (mm) tall and about 8 mm wide. According to one or more embodiments, the first peg 232 is about 3 millimeters (mm) tall and about 4 mm wide. According to other embodiments, the dimensions of these elements can vary in accordance with structural and/or signal propagation/transmittance requirements.

Figure 3A:
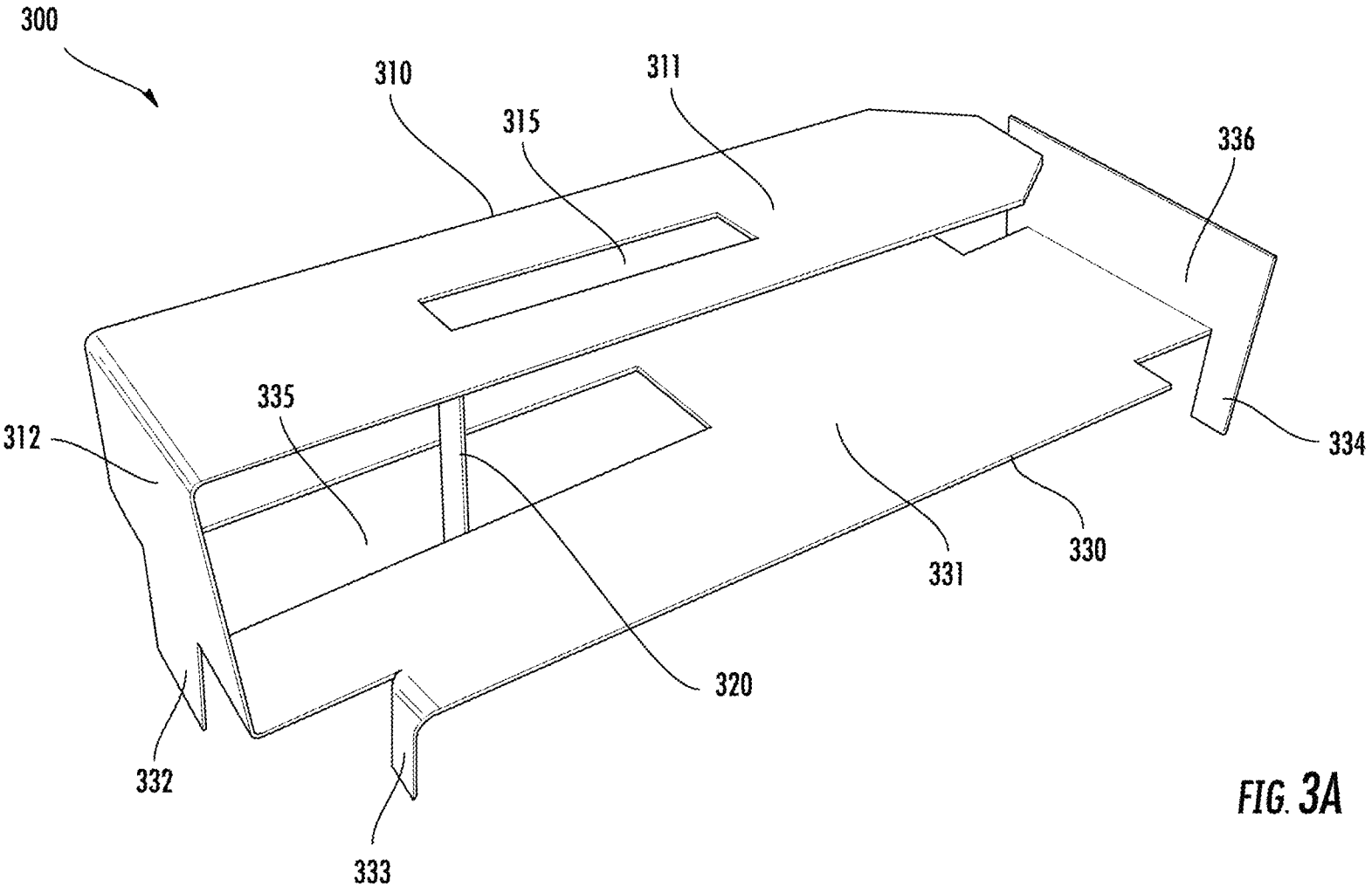
FIG. 3A is a perspective view of an antenna in accordance with one or more embodiments.
Figure 3B:
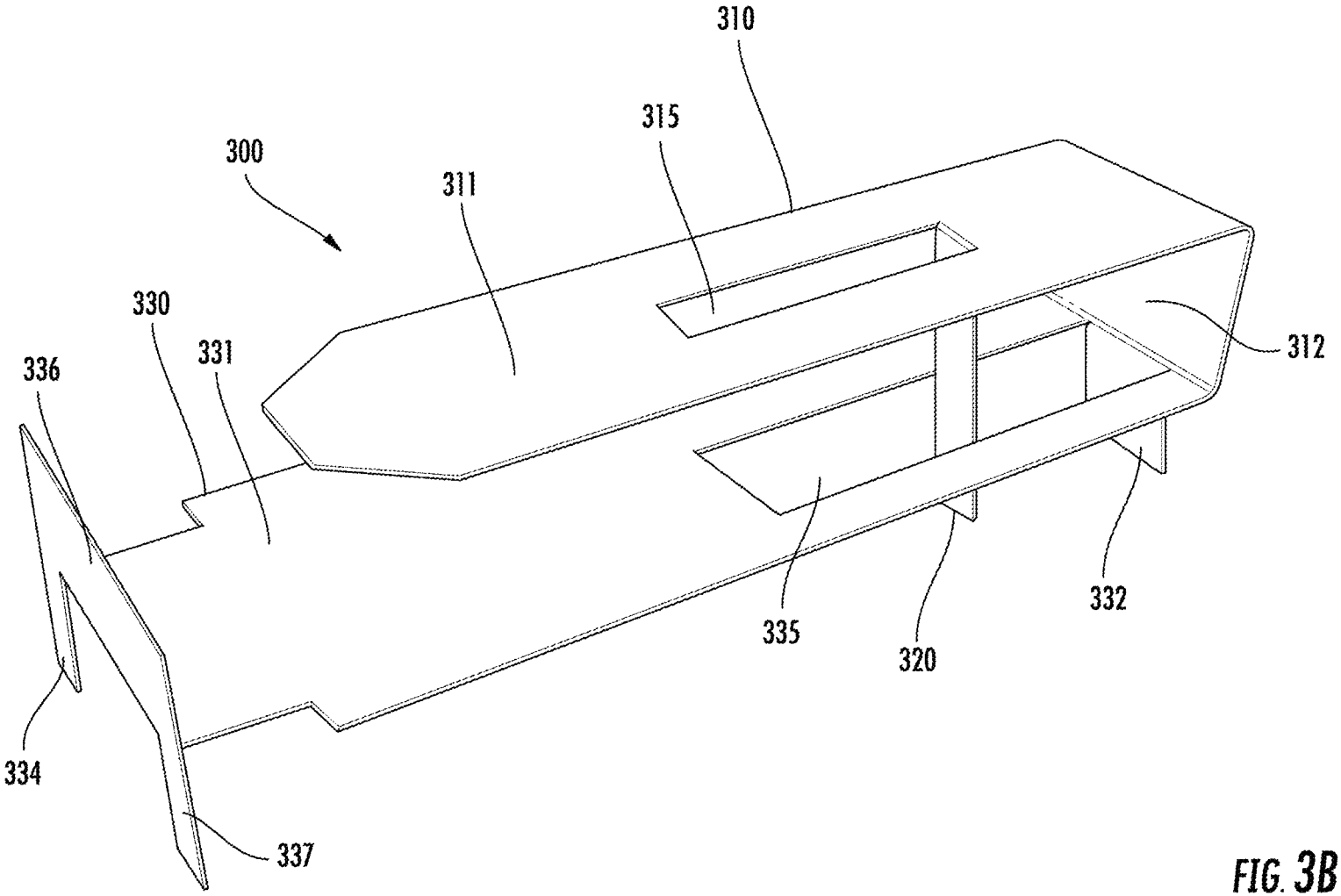
FIG. 3B is an alternative perspective view of the antenna from FIG. 3A in accordance with one or more embodiments.

FIG. 3A is a perspective view of another antenna 300 in accordance with one or more embodiments. FIG. 3B is an alternative perspective view of the antenna 300 from FIG. 3A in accordance with one or more embodiments.

As shown, the antenna 300 includes a reflector/shield portion 330 formed of a lower surface 331 that extends in a horizontal direction and includes a through-hole 335. The antenna 300 also includes an antenna portion 310 formed of an upper surface 311 that extends in the horizontal direction and a vertically extending side 312 that is joined between the upper surface 311 and the lower surface 331. The antenna 300 also includes a feed point 320 formed of a through-hole flap 320 attached and extending from the upper surface 311 down and through the through-hole 335 of the lower surface 331. The antenna 300 further includes the ability for the lower surface 331 and the through-hole flap 320 to attach to a printed circuit board (PCB).

According to one or more embodiments, the reflector/shield portion 330 can include a vertically extending edge 336 at an end opposite the end where the vertically extending side 312 is joined to the lower surface 331. The vertically extending edge 336 is formed by bending the lower surface 331 of the reflector/shield portion 330 to form the vertically extending edge 336 as shown in FIGS. 3A and 3B.

Further, according to one or more embodiments, the reflector/shield portion 330 can further include a first peg 332 extending from an edge of the through-hole 335 downward toward the PCB. This first peg 332 can be used to connect the antenna 300 to a PCB. According to other embodiments, the first peg 332 can be placed extending down from any of the other edges of the through-hole 335.

According to other embodiments, the reflector/shield portion 330 also includes a second peg 334 and a third peg 337 (see FIG. 3B) extending from a vertically extending edge 336 downward toward the PCB. Further, according to another embodiment, a fourth peg 333 can be provided that is attached to an outer edge of the reflector/shield portion 330 and extending downward toward the PCB. These pegs 333, 334, and 337 are used to fasten the antenna 300 to a PCB. According to one or more embodiments, the pegs 333, 334, and 337 can provide additional structural rigidity. Further, the pegs 333, 334, and 337 can provide clearance space when mounting the overall device. Also, the pegs 333, 334, and 337 can also affect and adjust the antenna reception.

Figure 4:
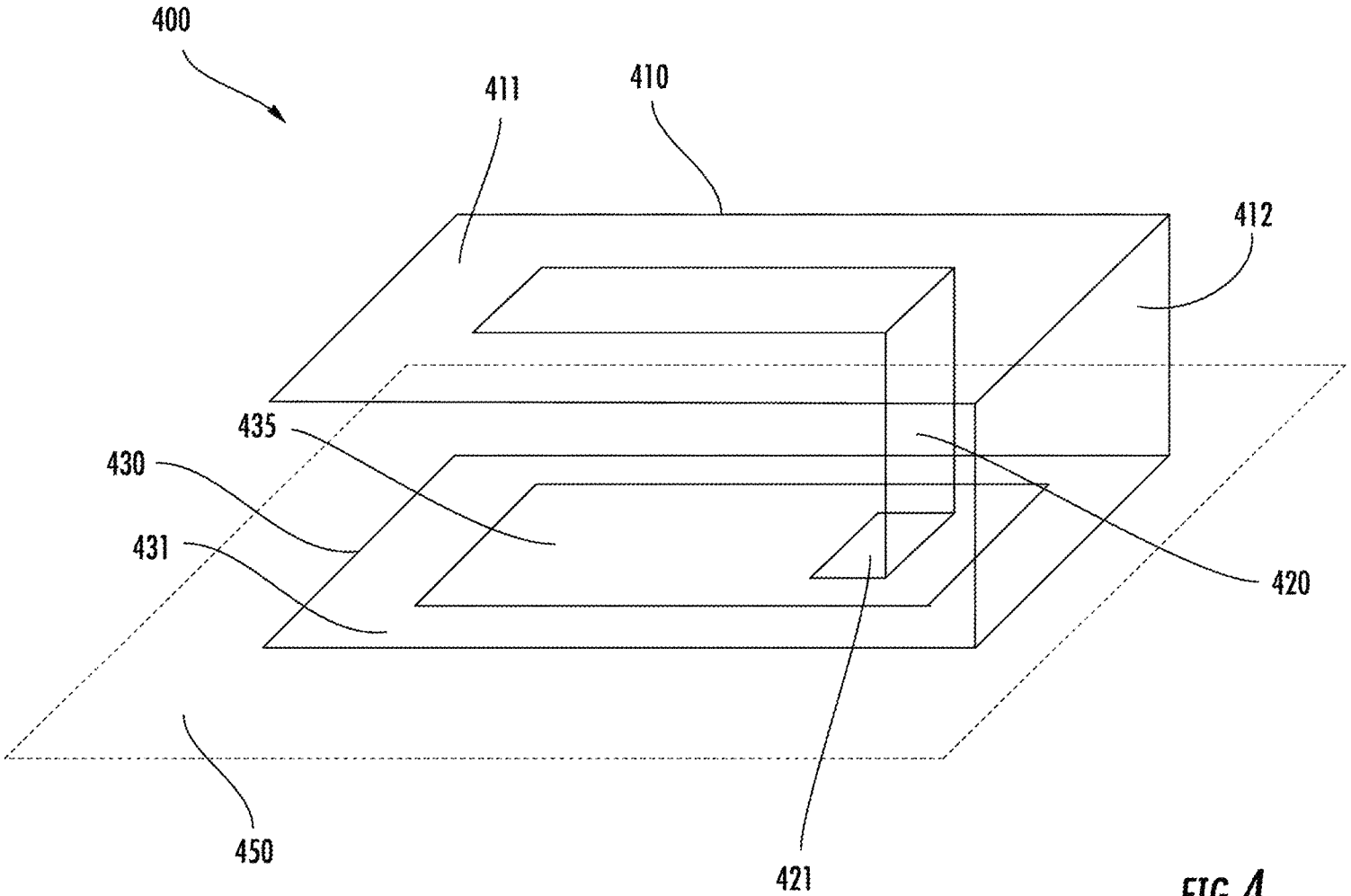
FIG. 4 is a translucent perspective view of an antenna that is flush mounted to a PCB in accordance with one or more embodiments.

FIG. 4 is a translucent perspective view of an antenna 400 flush mounted to a PCB 450 in accordance with one or more embodiments. The antenna 400 includes a reflector/shield portion 430 formed of a lower surface 431 that extends in a horizontal direction and includes a through-hole 435. The antenna 400 also includes an antenna portion 410 formed of an upper surface 411 that extends in the horizontal direction and a vertically extending side 412 that is joined between the upper surface 411 and the lower surface 431.

The antenna 400 also includes a feed point 420 formed of a through-hole flap 420 attached and extending from the upper surface 411 down and through the through-hole 435 of the lower surface 431. The antenna 400 further includes the ability for the lower surface 431 and the through-hole flap 420 to attach to a printed circuit board (PCB). Specifically, the feed point 420 further includes a foot portion 421. The foot portion 421 is a horizontally extending foot portion 421 formed at an end of the feed point 420 that extends downward. The foot portion 421 is formed by bending the end of the feed point 420. This provided the antenna 400 with the ability to be flush mounted to the PCB 450 as shown. Alternatively, as shown in other figures, the antenna can be connected using one or more pegs in accordance with one or more other embodiments.

Figure 5A:
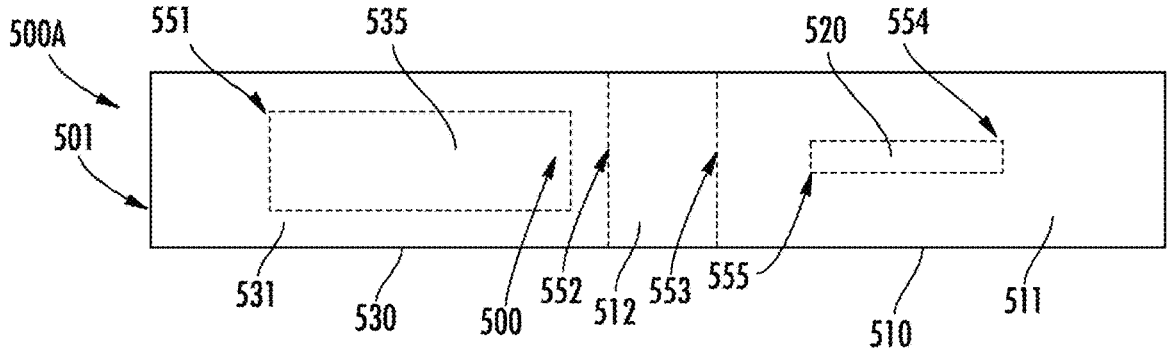
FIG. 5A is a top view of a single sheet of metal showing a plurality of incisions and a plurality of bend points for forming an antenna in accordance with one or more embodiments.

FIG. 5A is a top view of a single sheet of metal 501 showing a plurality of incisions and a plurality of bend points for forming an antenna 500A in accordance with one or more embodiments.

The antenna 500A includes a reflector/shield portion 530 formed of a lower surface 531 that extends in a horizontal direction and includes a through-hole 535. This is formed by the incision 551. The antenna 500A also includes an antenna portion 510 formed of an upper surface 511 that extends in the horizontal direction and a vertically extending side 512 that is joined between the upper surface 511 and the lower surface 531. The vertically extending side 512 is formed by bending at bend points 552 and 553. The antenna 500 also includes a feed point 520 formed of a through-hole flap 520 attached and extending from the upper surface 511 down and through the through-hole 535 of the lower surface 531 once it is bent into shape. The antenna 500A further includes the ability for the lower surface 531 and the through-hole flap 520 to attach to a printed circuit board (PCB). The feed point 520 is formed by the incision 554 and bending along the bend point 555.

Figure 5B:
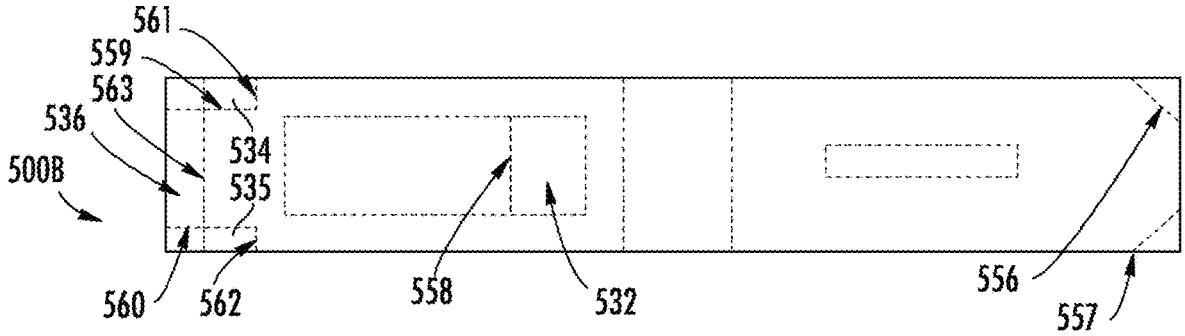
FIG. 5B is a top view of a single sheet of metal showing a plurality of incisions and a plurality of bend points for forming an antenna in accordance with one or more embodiments.

FIG. 5B is a top view of a single sheet of metal showing a plurality of incisions and a plurality of bend points for forming an antenna 500B in accordance with one or more embodiments. As shown the antenna 500B can include all the elements of the antenna 500A from FIG. 5A. Additionally, as shown the upper surface 511 can further include incisions 556 and 557 to cut off the corners. Additionally incision 558 can be included to create a first peg 532. Additional incisions 559 and 560 along with bending points 561 and 562 can be provided that form a second and a third peg 534 and 535. Further, a vertically extending edge 536 can be formed using bending portion 563.

Figure 5C:
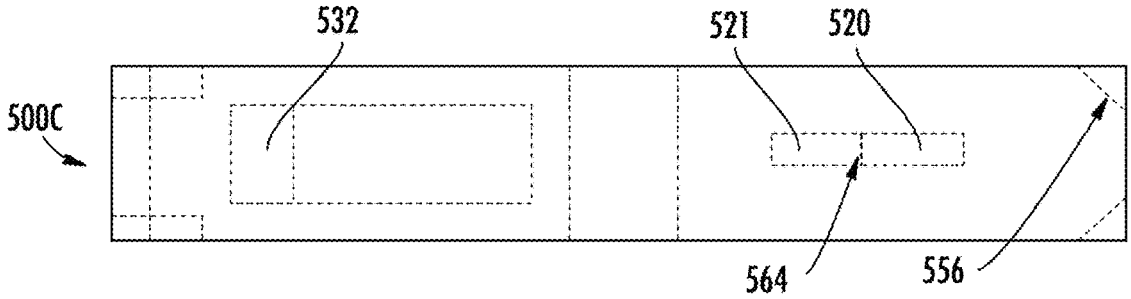
FIG. 5C is a top view of a single sheet of metal showing a plurality of incisions and a plurality of bend points for forming an antenna in accordance with one or more embodiments.

FIG. 5C is a top view of a single sheet of metal showing a plurality of incisions and a plurality of bend points for forming an antenna 500C in accordance with one or more embodiments. As shown the antenna 500C can include similar elements to those of the antenna 500B from FIG. 5B. A few differences include moving the first peg 532 to another edge of the cavity 535 as shown. Also, the feed point 520 has also been flipped such that is extends down from another edge of a cavity formed in the upper surface 511. Further, an additional bending portion 564 is included on the feed point 520 forming a foot portion 521. Further, incision 565 is provided to give the antenna portion 510 a curved edge. According to other embodiments additional incisions can be included to provide the overall device with additional curved edges. For example, other corners can be are cut into rounded forms.

According to one or more embodiments, the sheet of metal is made from copper, copper alloy, stainless steel, phosphorous bronze, beryllium copper, aluminum, and/or a combination thereof. According to other embodiments, the metal selected can be any metal or alloy that provides properties conducive for an antenna design.

Figure 6:
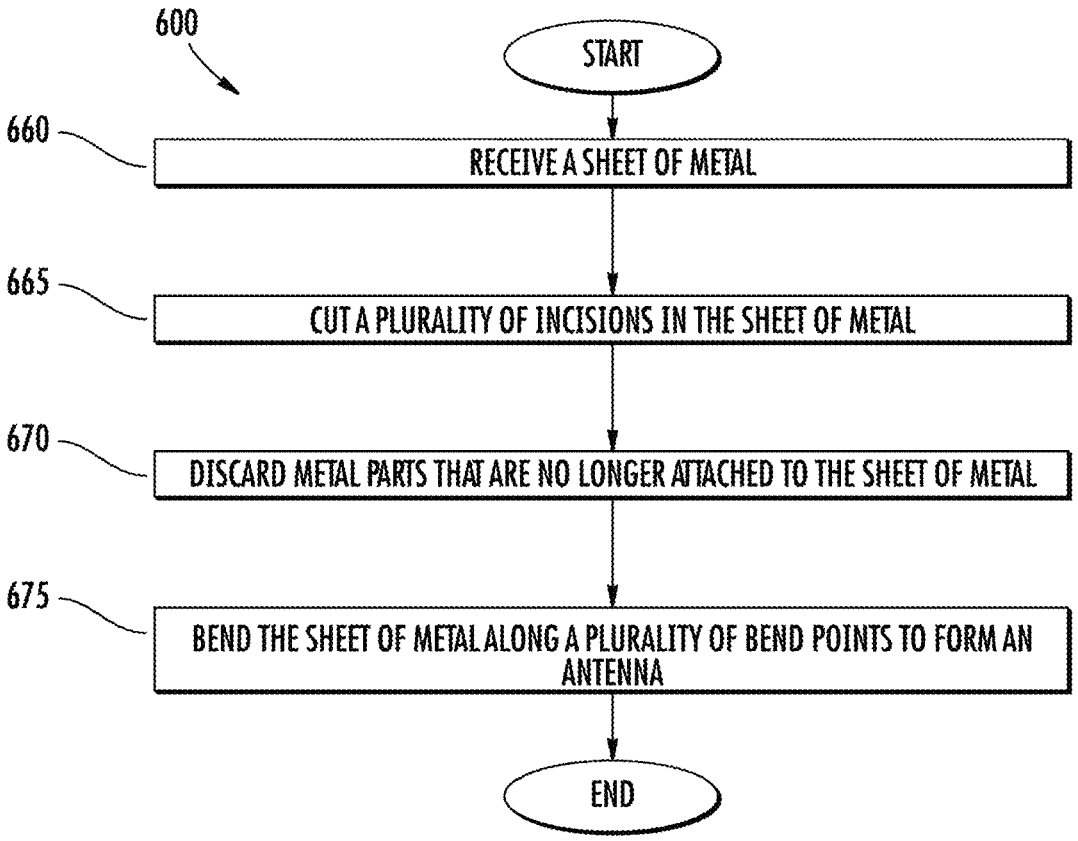
FIG. 6 is a flow chart of a method of forming an antenna in accordance with one or more embodiments.

FIG. 6 is a flow chart of a method 600 of forming an antenna in accordance with one or more embodiments. According to one or more embodiments, the method 600 includes receiving a sheet of metal (operation 660). The method 600 also includes cutting a plurality of incisions in the sheet metal (operation 665). Further, the method includes discarding metal parts that are no longer attached to the sheet of metal (operation 670). Additionally, the method 600 includes bending the sheet of metal along a plurality of bend points to form an antenna (operation 675).

According to one or more embodiments, cutting a plurality of incision in the sheet metal includes making the incisions using stamping and/or making the incisions using etching.

Advantageously, embodiments described herein provide one piece construction. Additionally one or more embodiments are also board mountable in either a flush or raised fashion. Further, one or more embodiments provide inexpensive construction and maintenance costs. Further, one or more embodiments also provide improved performance and additional structural and signal propagation reliability. Further, one or more embodiments provide a cheap, stable, and reliable antenna that also provided performance improvements due to better ground connection to the antenna and the elimination of losses previously provided by the cables and connectors.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof.

Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A single piece of sheet metal antenna comprising:

a reflector/shield portion formed of a lower surface that extends in a horizontal direction and includes a through-hole;

an antenna portion formed of an upper surface that extends in the horizontal direction and a vertically extending side that is joined between the upper surface and the lower surface; and a feed point formed of a through-hole flap attached and extending from the upper surface down and through the through-hole of the lower surface;

wherein the lower surface and the through-hole flap are configured to attach to a printed circuit board (PCB);

wherein the reflector/shield portion further comprises:

a vertically extending edge at an end opposite the end where the vertically extending side is joined;

a first peg extending from an edge of the through-hole downward toward the PCB;

a second peg and a third peg extending from the vertically extending edge downward toward the PCB; and wherein the vertically extending edge is formed by bending the reflector/shield portion.

2. The single piece of sheet metal antenna of claim 1, wherein the reflector/shield portion further comprises:

a fourth peg attached to an outer edge of the reflector/shield portion and extending downward toward the PCB.

3. The single piece of sheet metal antenna of claim 1 wherein the feed point further comprises:

a horizontally extending foot portion formed at an end of the feed point that extends downward, wherein the foot portion is formed by bending the end of the feed point.

4. The single piece of sheet metal antenna of claim 1, wherein a corner of the upper surface is cut into rounded form.

5. The single piece of sheet metal antenna of claim 1, wherein the sheet of metal is made from one or more selected from a group consisting of copper, copper alloy, stainless steel, phosphorous bronze, beryllium copper, and aluminum.

6. The single piece of sheet metal antenna of claim 1, wherein the sheet of metal is 0.3 millimeters (mm) thick.

7. The single piece of sheet metal antenna of claim 1, wherein the lower surface of the reflector/shield portion is 35 millimeters (mm) long and 8 mm wide and the through-hole of the reflector/shield portion is 23 mm long and 4 mm wide;

wherein the upper surface of the antenna portion is 28.1 mm long and 8 mm wide and the vertically extending side of the antenna portion is 5 mm tall and 8 mm wide, and wherein the feed point is 8 mm tall and 1 mm wide.

8. The single piece of sheet metal antenna of claim 1, wherein the feed point is 5 millimeters (mm) away from the vertically extending side of the antenna portion, and wherein the through-hole of the reflector/shield portion is 3 mm from the vertically extending side of the antenna portion.

9. The single piece of sheet metal antenna of claim 1, wherein the vertically extending edge of the reflector/shield portion is 2.5 millimeters (mm) tall and 8 mm wide.

10. The single piece of sheet metal antenna of claim 1, wherein the first peg is 3 millimeters (mm) tall and 4 mm wide.

11. A system for wireless communication, the system comprising:

a single sheet of metal antenna comprising:

a reflector/shield portion formed of a lower surface that extends in a horizontal direction and includes a through-hole;

an antenna portion formed of an upper surface that extends in the horizontal direction and a vertically extending side that is joined between the upper surface and the lower surface; and a feed point formed of a through-hole flap attached and extending from the upper surface down and through the through-hole of the lower surface;

a printed circuit board (PCB) upon which the lower surface and the through-hole flap of the single sheet of metal antenna are attached;

wherein the reflector/shield portion further comprises:

a vertically extending edge at an end opposite the end where the vertically extending side is joined, a first peg extending from an edge of the through-hole downward toward the PCB;

a second peg and a third peg extending from the vertically extending edge downward toward the PCB;

wherein the vertically extending edge is formed by bending the reflector/shield portion.

12. The system of claim 11, wherein the reflector/shield portion further comprises:

a fourth peg attached to an outer edge of the reflector/shield portion and extending downward toward the PCB.

13. The system of claim 11, wherein the feed point further comprises:

a horizontally extending foot portion formed at an end of the feed point that extends downward, wherein the foot portion is formed by bending the end of the feed point.

14. The system of claim 11, wherein a corner of the upper surface is cut into rounded form.

15. The system of claim 11, wherein the sheet of metal is made from one or more selected from a group consisting of copper, copper alloy, stainless steel, phosphorous bronze, beryllium copper, and aluminum.

16. The single piece of sheet metal antenna of claim 12, wherein the sheet of metal is 0.3 millimeters (mm) thick, wherein the lower surface of the reflector/shield portion is 35 millimeters (mm) long and 8 mm wide and the through-hole of the reflector/shield portion is 23 mm long and 4 mm wide;

wherein the upper surface of the antenna portion is 28.1 mm long and 8 mm wide and the vertically extending side of the antenna portion is 5 mm tall and 8 mm wide, wherein the feed point is 8 mm tall and 1 mm wide, wherein the feed point is 5 millimeters (mm) away from the vertically extending side of the antenna portion, wherein the through-hole of the reflector/shield portion is 3 mm from the vertically extending side of the antenna portion, wherein the vertically extending edge of the reflector/shield portion is 2.5 millimeters (mm) tall and 8 mm wide, and wherein the first peg is 3 millimeters (mm) tall and 4 mm wide.

17. A method to create a single sheet of metal antenna, the method comprising:

receiving a sheet of metal;

cutting a plurality of incisions in the sheet metal;

discarding metal parts that are no longer attached to the sheet of metal; and bending the sheet of metal along a plurality of bend points to form the antenna of claim 1.

18. The method of claim 17, wherein cutting a plurality of incision in the sheet metal includes one or more of making the incisions using stamping and making the incisions using etching.

* * * * *